US007636063B2

(12) United States Patent
Channabasappa

(10) Patent No.: US 7,636,063 B2
(45) Date of Patent: Dec. 22, 2009

(54) COMPACT BROADBAND PATCH ANTENNA

(76) Inventor: Eswarappa Channabasappa, 1 Oxbow Dr., Acton, MA (US) 01720

( * ) Notice: Subject to any disclaimer, the term of this patent is extended or adjusted under 35 U.S.C. 154(b) by 0 days.

(21) Appl. No.: 11/293,558

(22) Filed: Dec. 2, 2005

(65) Prior Publication Data

US 2007/0126638 A1 Jun. 7, 2007

(51) Int. Cl.
*H01Q 1/38* (2006.01)

(52) U.S. Cl. ..... 343/700 MS

(58) Field of Classification Search ..... 343/700 MS, 343/778, 756, 786, 769
See application file for complete search history.

(56) References Cited

U.S. PATENT DOCUMENTS

| | | | | |
|---|---|---|---|---|
| 3,665,480 | A | 5/1972 | Fassett | |
| 4,197,544 | A | 4/1980 | Kaloi | |
| 4,208,660 | A | 6/1980 | McOwen, Jr. | |
| 4,486,758 | A | 12/1984 | de Ronde | |
| 4,851,855 | A | 7/1989 | Tsukamoto et al. | |
| 4,857,938 | A | 8/1989 | Tsukamoto et al. | |
| 5,001,444 | A * | 3/1991 | Salvan et al. | 333/135 |
| 5,874,919 | A | 2/1999 | Rawnick et al. | |
| 6,091,373 | A * | 7/2000 | Raguenet | 343/778 |
| 6,128,471 | A | 10/2000 | Quelch et al. | |
| 6,756,942 | B2 | 6/2004 | Heyde | 343/700 |
| 6,759,986 | B1 | 7/2004 | Anderson et al. | 343/700 |
| 6,806,831 | B2 | 10/2004 | Johansson et al. | 343/700 |
| 6,885,343 | B2 | 4/2005 | Roper | |
| 6,897,809 | B2 * | 5/2005 | Carson et al. | 343/700 MS |
| 7,102,571 | B2 * | 9/2006 | McCarrick | 343/700 MS |
| 2003/0043076 | A1 * | 3/2003 | Carson et al. | 343/700 MS |
| 2003/0184477 | A1 | 10/2003 | Shafai et al. | |
| 2004/0119645 | A1 * | 6/2004 | Lee et al. | 343/700 MS |
| 2004/0189528 | A1 * | 9/2004 | Killen et al. | 343/700 MS |
| 2004/0252058 | A1 * | 12/2004 | Rawnick et al. | 343/700 MS |
| 2005/0090300 | A1 * | 4/2005 | Zhang et al. | 455/575.7 |

(Continued)

FOREIGN PATENT DOCUMENTS

EP 0 272 752 A2 6/1988

(Continued)

OTHER PUBLICATIONS

James S. McLean; "A Re-Examination of the Fundamental Limits on the Radiation Q of Electrically Small Antennas;" IEEE Transactions on Antennas and Propagation, vol. 44, No. 5, May 1996; 672-676.

(Continued)

*Primary Examiner*—Huedung Mancuso

(57) ABSTRACT

The invention provides a compact patch antenna having a cavity underneath the driver patch, so that the electromagnetic volume of the antenna is expanded without increasing the overall area of the antenna. More specifically, the compact patch antenna comprises a base layer having a cavity, a ground plane located on the base layer, and having an opening over at least a portion of the cavity, a substrate located on the ground plane, and a driver patch located on the substrate. The invention further provides a method for constructing a compact patch antenna, comprising the steps of providing a base layer having a cavity, providing a ground plane located on the base layer, and having an opening over at least a portion of the cavity, providing a substrate located on the ground plane, and providing a driver patch located on the substrate.

24 Claims, 5 Drawing Sheets

U.S. PATENT DOCUMENTS

| | | | | |
|---|---|---|---|---|
| 2005/0151688 | A1* | 7/2005 | Khoo et al. | 343/700 MS |
| 2005/0179592 | A1* | 8/2005 | Shafai et al. | 343/700 MS |
| 2007/0080864 | A1 | 4/2007 | Channabasappa | |

FOREIGN PATENT DOCUMENTS

| | | | |
|---|---|---|---|
| EP | 0 481 417 | A1 | 4/1990 |
| EP | 0 439 677 | A2 | 8/1991 |
| GB | 2 399 949 | A | 9/2004 |

OTHER PUBLICATIONS

Croq et al.; "Millimeter-Wave Design of Wide-Band Aperture-Coupled Stacked Microstrip Antennas;" IEEE Transactions on Antennas and Propagation, vol. 39, No. 12, Dec. 1991; 1770-1776.

Zavosh et al.; "Improving the Performance of Microstrip-Patch Antennas;" IEEE Antennas and Propagation Magazine, vol. 38, No. 4, Aug. 1996; 7-12.

Skrivervik et al.; "PCS Antenna Design: The Challenge of Miniaturization;" IEEE Antennas and Propagation Magazine, vol. 43, No. 4, Aug. 2001; 12-27.

Egashira et al.; "Stacked Microstrip Antenna with Wide Bandwidth and High Gain;" IEEE Transactions and Antennas and Propagation, vol. 44, No. 11, Nov. 1996; 1533-1534.

Rafi GH. et al: "Broadband microstrip patch antenna with V-slot" IEE Proceedings: Microwaves, Antennas and Propagation, IEE, Stevenage, Herts, GB, vol. 151, No. 5, Aug. 3, 2004, pp. 435-440, XP006022872.

Gonzalez M A et al: "Design of low cost cavity-backed microstrip patch arrays" IEEE Antennas and Propagation Society International Symposium. 2001 Digest. APS. Boston, MA Jul. 8-13, 2001, New York, NY IEEE, US, vol. vol. 1 of 4, Jul. 8, 2001, pp. 590-593, XP010564356.

Aberle J T Ed—Institute of Electrical and Electronics Engineers; "On the use of metallized cavities backing microstrip antennas" Proceedings of the Antennas and Propagation Society Annual Meeting, 1991, New York, IEEE, US, vol. vol. 2, Jun. 24, 1991, pp. 60-63 XP010050805.

Zavosh et al., "Single and Stacked Circular Microstrip Patch Antennas Backed by a Circular Cavity", IEEE Transactions on Antennas and Propagation, vol. 43, No. 7, Jul. 1995, pp. 746-750.

Volakis J L et al: "A Scheme to Lower the Resonant Frequency of the Microscript Patch Antenna" IEEE Microwave and Guided Wave Letters, IEEE Inc., New York, US , vol. 2, No. 7, Jul. 1, 1992, pp. 292-293, XPOO279147 ISSN: 1051-8207.

Besancon R et al.: "High Integrated Technology for Multifunction SAR Radiating Board" 25th. ESA Antenna Workshiop on Satellite Antenna Technology, Noodwijk, the Netherlands, Sep. 18-20, 2002, ESA Antenna Workshop on Satellite Antenna Technology, NL, Noorwijk: ESA, Sep. 18, 2002, pp. 39042, XP001128805.

* cited by examiner

Stacked Patch Antenna

Patch Antenna

Antenna Elements Coupled in H-Plane

Antenna Elements Coupled in E-Plane

COMPACT BROADBAND PATCH ANTENNA

FIELD OF THE INVENTION

The present invention relates to communications antennas, and more specifically relates to a novel microstrip patch antenna suitable for use in an antenna array.

BACKGROUND OF THE INVENTION

A modern trend in the design of antennas for wireless devices is to combine two or more antenna elements into an antenna array. Each antenna element in such an array should have a small footprint, a low level of mutual coupling with neighboring elements, a low element return loss, a low axial ratio (in case of circular polarization), and a large frequency bandwidth. For a typical antenna element in an antenna array, however, these requirements are typically at odds with each other. For example, the larger the bandwidth and the larger the size of an antenna element, the stronger will be the mutual coupling between the antenna element and its neighboring elements in the antenna array.

FIG. 1 depicts a conventional patch antenna element 100 for use in an antenna array. Patch antenna element 100 includes a driver patch 110 and a ground plane 130, separated by a dielectric substrate 120. An input signal having a given wavelength $\lambda$ is inserted via a microstrip feed line (not shown) connected to the driver patch 110. The length L of the patch is typically selected to be ½ of the wavelength, so that the patch resonates at the signal frequency of the signal and thereby transmits the desired wireless signal. At low frequencies, however, the wavelength $\lambda$ can be very long, and the patch antenna dimension L can become quite large.

A known technique to reduce the size of the patch antenna element is to select a dielectric substrate 120 with a very high permittivity $\in_S$ (e.g., $\in_S$=6 to 20 relative to air). The high permittivity substrate reduces the resonant frequency of the patch antenna element 100 and thus allows a smaller driver patch to be used for a given signal frequency f. More specifically, for the patch antenna element shown in FIG. 1, and for a given signal frequency f, the length of the driver patch is conventionally selected to be inversely proportional to the square root of the permittivity $\in_S$ of the substrate 120. For example, if the length L were nominally 1 cm for a substrate permittivity of 1, the length L could be reduced to 0.5 cm for a substrate having a permittivity of 4 were used, or to 0.33 cm for a substrate having a permittivity of 9.

The effect of the increased dielectric permittivity is to raise the capacitance between the patch 110 and ground plane 130 and thereby to lower the resonant frequency. Unfortunately, the reduced antenna volume decreases the bandwidth of the antenna element and causes difficulties with impedance matching. Using conventional design methods known to those of skill in the art, the bandwidth may be improved to some extent by increasing the thickness of the substrate. A thicker substrate, however, introduces additional problems by (i) increasing the antenna's cost; (ii) increasing the antenna's mass (or weight), which may be unacceptable in space applications; and (iii) exciting unwanted electromagnetic waves at the substrate's surface, which lead poor radiation efficiency, larger mutual coupling between antenna elements and distorted radiation patterns. Moreover, a very thin substrate is conventionally used for the feed network—including, e.g., the microstrip feed line (not shown)—and it is preferable to build antenna elements with the same substrate as that used for the feed network.

FIG. 2 depicts another known technique to improve the bandwidth of an antenna element by adding a parasitic patch above the driver patch, resulting in a "stacked patch antenna." Stacked patch antennas have been described in the article entitled "Stacked Microstrip Antenna with Wide Bandwidth and High Gain" by Egashira et al., published in IEEE Transactions on Antennas and Propagation, Vol. 44, No. 11 (November 1996); and in U.S. Pat. Nos. 6,759,986; 6,756,942; and 6,806,831. As shown in FIG. 2, a conventional stacked patch antenna 200 includes a ground plane 250 supporting a dielectric substrate 240, a driver patch 230, a foam dielectric 220 having a permittivity similar to air, and a parasitic patch 210 (also known as a "driven patch" or "stacked patch"). A signal to be transmitted is input to the driver patch 230. The parasitic patch 210 is electromagnetically coupled to the driver patch 230 and therefore resonates with it. The additional resonance provided by the parasitic patch 210 improves the operational frequency of the stacked patch antenna 200 and increases the bandwidth of the antenna. In conventional stacked patch antennas, however, parasitic patch 210 must be fairly large in comparison with driver patch 230, as reflected in FIG. 2, due to the relatively low permittivity of the foam dielectric 220. As a result, when stacked patch antenna elements are combined in an antenna array, adjacent elements exhibit a strong mutual coupling effect on each other, which negatively impacts antenna element and array gain, radiation patterns, bandwidth and scanning ability of antenna array. Furthermore, in view of recent trends in miniaturization, conventional stacked patch antennas are still too large.

Thus, in conventional designs, the performance of a patch antenna is compromised in order to reduce the size of the antenna. Accordingly, there is a need for a patch antenna that requires a smaller volume than existing antennas without compromising the performance of the antenna. The present invention fulfills this need among others.

SUMMARY OF THE INVENTION

The present invention provides for a compact broadband patch antenna in which a cavity is etched in a substrate under the driver patch. The inventors have discovered that the cavity expands the electromagnetic volume of the antenna element and greatly enhances the efficiency and bandwidth of the antenna by increasing the capacitive loading of the driver patch. Indeed, the efficiency of the antenna may be increased from about 45% (for very thin substrates) to 95% (for thicker substrates).

More specifically, the broadband patch antenna according to the invention comprises: (1) a base layer having a cavity; (2) a ground plane located on the base layer, and having an opening that allows electromagnetic coupling between the patch and the cavity; (3) a thin substrate located on the ground plane; and (4) a driver patch located on the thin substrate. The inventors have found that the use of the cavity in this manner greatly increases the capacitive loading of the patch, which in turn significantly improves the resonant frequency characteristics of the patch antenna. As a result, for a given resonant frequency, the broadband patch antenna in accordance with the invention takes up a significantly smaller surface area on an integrated patch antenna die and has a much smaller mass than a conventional patch antenna having the same resonant frequency.

Advantageously, the size, location and/or shape of the opening in the ground plane may be adjusted during the design of the antenna in order to obtain a desired capacitive loading from the patch to the ground plane. Because the capacitive loading largely determines the resonant frequency of the driver patch, a desired resonant frequency of the driver patch can be set during the design of the antenna simply by selecting an appropriate geometry (size, shape and/or location) for the opening in the ground plane.

In still further embodiments, the broadband patch antenna may include a parasitic patch, located over and separated from the driver patch by a radome or a layer of foam or other dielectric material. The driver patch and/or the parasitic patch may also include one or more slots, which further reduce the size of the antenna element and improve the performance of the antenna element and the associated antenna array.

The invention further provides a corresponding method for constructing a compact broadband patch antenna, comprising the steps of: (1) providing a base layer having a cavity, (2) providing a ground plane located on the base layer, and having an opening over at least a portion of the cavity; (3) providing a substrate located on the ground plane; and (4) providing a driver patch located on the substrate. The method may further include the steps of providing one or more parasitic patches located over and separated from the driver patch by a radome or a dielectric material, such as foam or substrate. The method may still further include the step of providing one or more slots in the driver patch and/or the one or more parasitic patches.

DETAILED DESCRIPTION OF THE INVENTION

Figure 2:
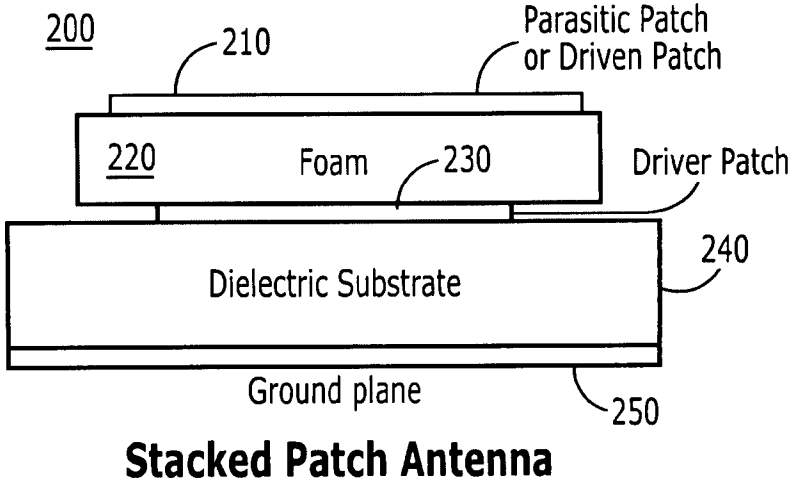
FIG. 2 (PRIOR ART)
FIG. 2 is a cross-sectional view of a stacked patch antenna in accordance with the prior art
Figure 1:
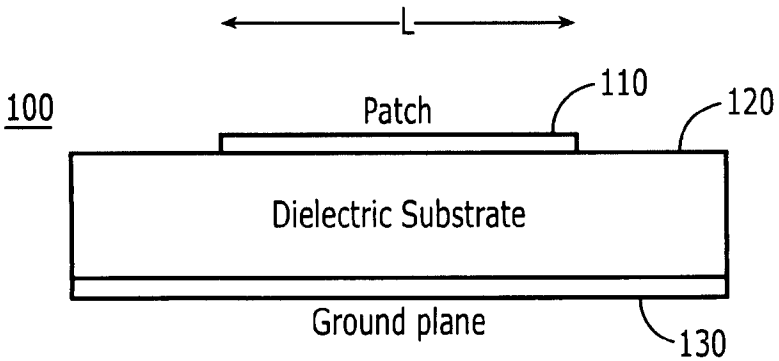
FIG. 1 (PRIOR ART)
FIG. 1 is a cross-sectional view of a patch antenna in accordance with the prior art.
Figure 3B:
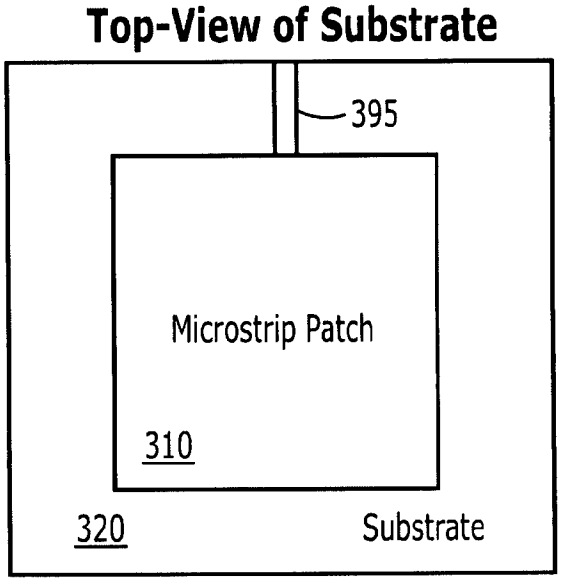
FIG. 3B is a top view of the broadband patch antenna in accordance with the present invention.
Figure 3C:
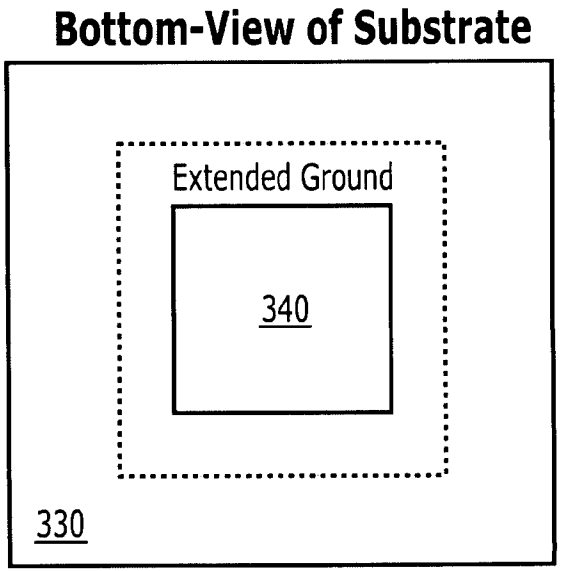
FIG. 3C is a bottom view of the broadband patch antenna in accordance with the present invention.
Figure 3A:
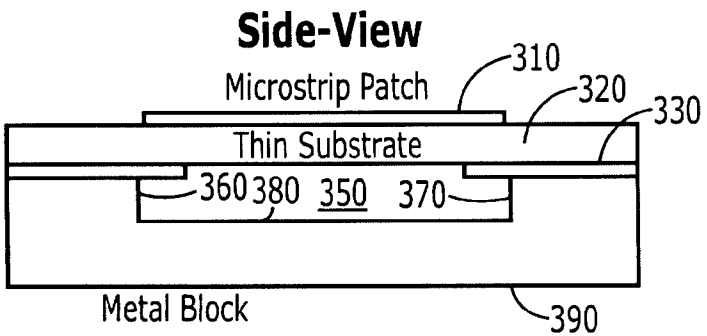
FIG. 3A is a cross-sectional view of a broadband patch antenna in accordance with the present invention.

Referring to FIGS. 3A, 3B, and 3C, an embodiment of the broadband patch antenna 300 is shown in a cross-sectional view (FIG. 3A), a top view (FIG. 3B) and a bottom view (FIG. 3C). The illustrated device comprises a base layer 390 having a cavity 350, a ground plane 330 having an opening 340 (shown in FIG. 3C), a dielectric substrate 320, and a driver patch 310. As in conventional patch antenna 100 described above, an input signal is preferably provided to the driver patch 310 via a microstrip line 395 (in FIG. 3B) and radiated outward by driver patch 310. Alternatively, the input signal may be provided via a coaxial probe feed passing upward through the base layer 390, cavity 350, and opening 340 to the driver patch 310.

The opening of the ground plane 330 may be larger than, coextensive with, or smaller than the cavity or the driver patch 310. Ground plane 330 is preferably extended beneath driver patch 310, such that at least a portion of the ground plane 330 overlaps the driver patch 310. Still more preferably, the ground plane opening 340 is centered over, and smaller than, the cavity 350, such that the ground plane 330 overlaps the driver patch 310 around the entire perimeter of the ground plane opening 340. Preferably, the overlap between the ground plane and the driver patch is selected based upon the thickness of the substrate. For thinner substrates, for example, the overlap could be as small as $0.01\lambda$ (one-hundredth of a wavelength). This overlap helps to lower the resonant frequency of the broadband patch antenna 300 by capacitively loading the driver patch 310. It thereby also helps to reduce the overall size of broadband patch antenna 300 without loading the cavity with a dielectric. It should be noted, however, that the broadband patch antenna 300 is suitable for operation without this overlap.

Base layer 390 is preferably a metal material such as aluminum, steel, silver or gold, milled or machined to form cavity 350. Alternatively, base layer 390 may be a semiconductive or insulating material formed by conventional photolithographic techniques. If base layer 390 is a semiconductor or insulator (e.g., a dielectric material), however, then the performance of the broadband patch antenna may be improved by lining the surfaces 360, 370, 380 of cavity 350 with a thin layer of conductive material, preferably a metal such as silver or gold. The metal lining on vertical surfaces 360 and 370 of the cavity may be provided in the form of an array of metal vias (not shown) around the perimeter of cavity 350, preferably at distances of approximately ⅛ to 1/10 of the wavelength. In this way, the electromagnetic field emitted by the driver patch 310 is contained and reflected back toward driver patch 310.

As described above, the cavity 350 serves to improve the radiation efficiency and thereby also to lower the overall dissipation loss of the driver patch. Without the back cavity, the currents in the driver patch 310 tend to be non-uniform, causing a higher resistive loss and thus lower radiation efficiency. In contrast, in the presence of the back cavity, the radiation efficiency is improved, because the effective dielectric thickness (thin substrate plus air cavity) is larger. By way of example, for thin substrates, the cavity helps to improve the radiation efficiency from about 50% to 90%.

Further, because the bandwidth of a stacked patch antenna is typically proportional to its volume (i.e., the volume below the driver patch), the cavity 350 also serves to improve the bandwidth of the broadband patch antenna by increasing the effective volume of the antenna below the driver patch. In general, the larger the volume, the better will be the resulting antenna bandwidth (until saturation eventually occurs). By expanding the three-dimensional volume of the antenna below the ground plane and into the space formed by the cavity 350, the bandwidth of the antenna is greatly enhanced. For example, without the cavity, the bandwidth will typically be in the range of about two to five percent of the centre operating frequency. In other words, if the centre frequency is 10 GHz, the bandwidth would be five percent of 10 GHz, or 0.5 GHz, such that the conventional patch antenna would operate from 9.75 GHz to 10.25 GHz. In contrast, with the cavity, a bandwidth in the range from about 10 to 16% may be achieved.

Dimensionally speaking, the cavity width is preferably slightly larger than that of the driver patch 310, and the cavity depth is preferably in the range of 0.01 to 0.02 times the signal wavelength. Because the cavity depth may be very small, it adds very little additional volume to the antenna array.

Cavity 350 in base layer 390 may also be filled or unfilled. Filling the cavity 350 with foam or another suitable dielectric material advantageously provides structural support to driver patch 310.

Substrate 320 may be any low loss substrate material conventionally used by those of skill in the art for constructing patch antennas, such as RT Duroid® or a Teflon®-based substrate as manufactured by Rogers Corporation, Taconic® and Arlon, Inc. Such substrates typically have a permittivity of about 2 to about 6.

Ground plane 330 and driver patch 310 may be any conductive material (including copper, aluminum, silver or gold). In practice, ground plane 330 is preferably formed by depositing the conductive material on the bottom surface of the dielectric substrate, while driver patch 310 is formed by depositing the conductive material on the top surface of the dielectric substrate.

Suitable dimensions for the compact broadband patch antenna shown in FIGS. 3A-3C signals may be selected using electromagnetic simulation techniques of the type conventionally used by those of skill in the art in the design of patch antennas. Suitable 3D electromagnetic simulation software packages include CST Microwave Studio® by CST of America, Inc. and HFSS™ by Ansoft Corp.

Figure 5:
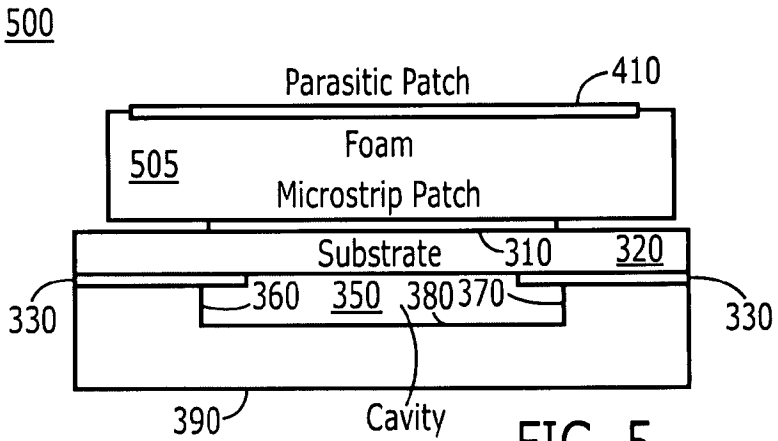
FIG. 5 is a cross-sectional view of a broadband patch antenna having a parasitic patch mounted on a foam layer in accordance with the present invention.
Figure 4:
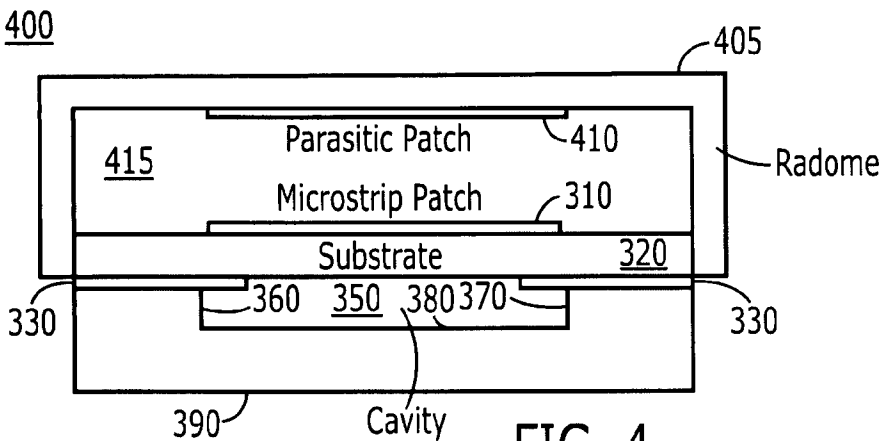
FIG. 4 is a cross-sectional view of a broadband patch antenna having a parasitic patch mounted on a radome in accordance with the present invention.

FIGS. 4 and 5 illustrate further embodiments of compact broadband patch antennae in accordance with the invention. In addition to the elements of antenna 300, antenna 400 in FIG. 4 further includes a parasitic patch 410, mounted under a radome 405. As in conventional stacked patch antennas, parasitic patch 410 resonates with the signal emitted by driver patch 310 and thereby improves the radiation characteristics of driver patch 310.

Parasitic patch 410 may be supported by a radome 405 (as in FIG. 4) or by a dielectric material 505 (as in FIG. 5). Radome 405 in FIG. 4 is preferably a polycarbonate material that provides structural support to resonant patch 410 and physical protection to the broadband patch antenna 400. Dielectric material 505 in FIG. 5 is preferably dielectric foam but may alternatively be formed from other dielectric materials. Because the permittivity of foam tends to be low (e.g., $\in_{FOAM}$~1), however, parasitic patch 410 may need to have a larger area than driver patch 310, if foam is used to support resonant patch 410.

Figure 6:
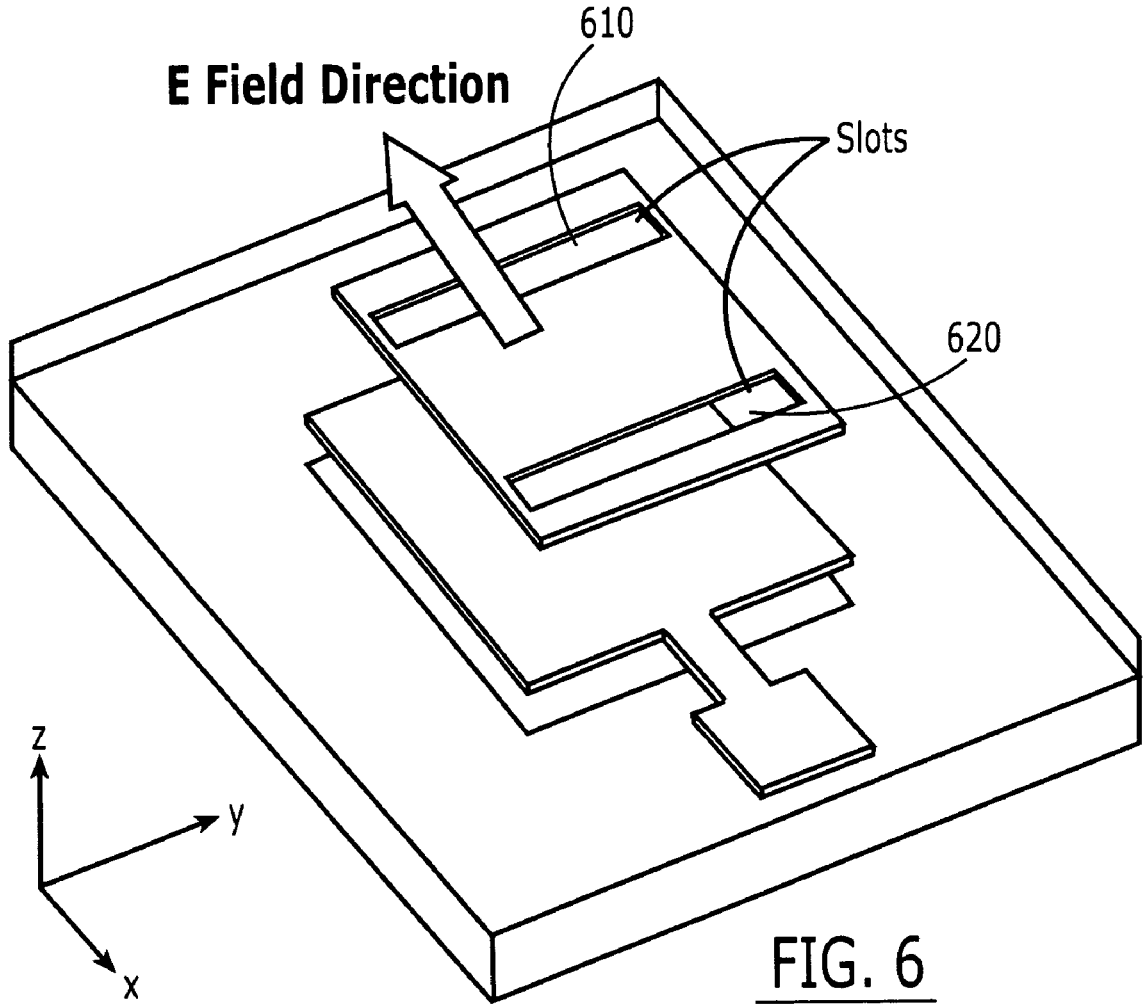
FIG. 6 is an isometric view of a broadband patch antenna having a parasitic patch with slots in accordance with the present invention.

FIG. 6 illustrates a further embodiment of a broadband patch antenna as in FIG. 3, to which slots 610 and 620 have been added in the parasitic patch 410, perpendicular to the direction of the electromagnetic field in the parasitic patch 410. These slots 610 and 620 provide a longer current path for electrical currents in the parasitic patch 410, thereby artificially increasing the electrical length of the current paths. Accordingly, the dimensions of the stacked patch antenna 400 may be made smaller without negatively impacting the antenna characteristics. Alternatively, a single slot may also be used.

Figure 7:
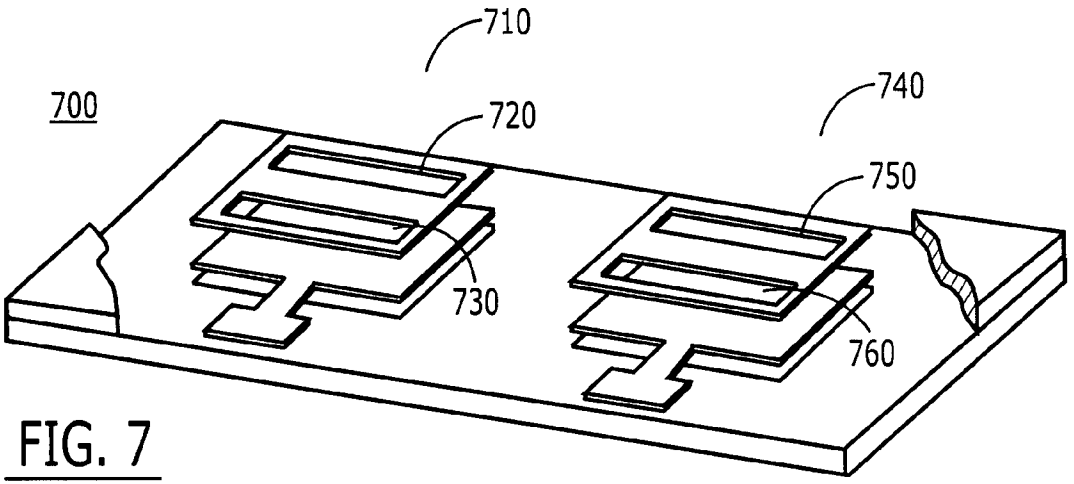
FIG. 7 is an isometric view of an antenna array including two broadband patch antenna elements in accordance with the present invention, coupled in the H-Plane.
Figure 8:
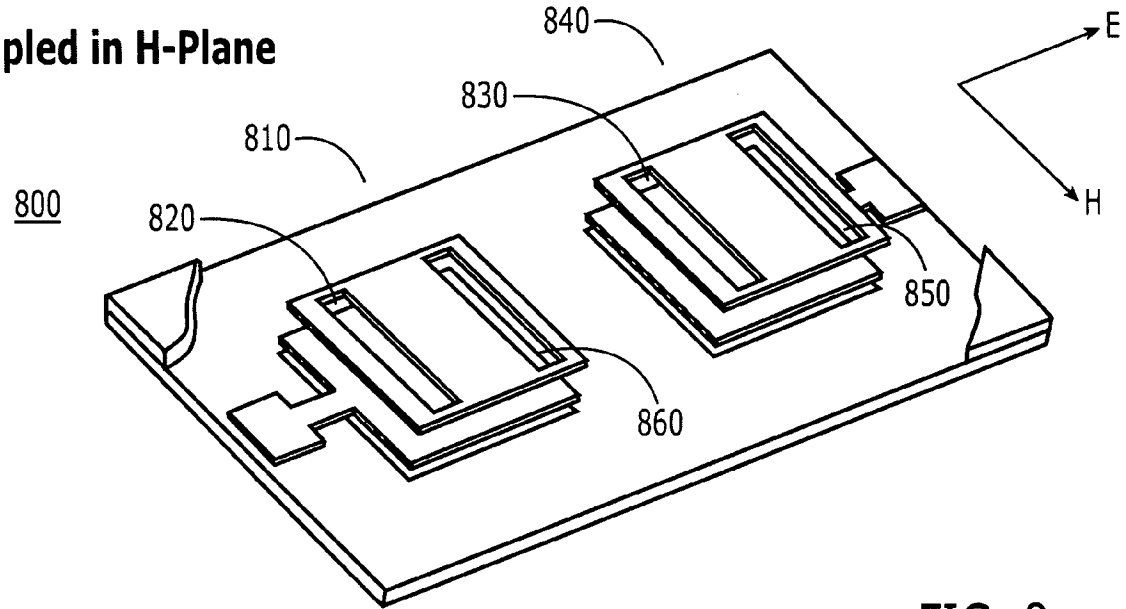
FIG. 8 is an isometric view of an antenna array including two broadband patch antenna elements in accordance with the present invention, coupled in the E-Plane.

FIGS. 7 and 8 illustrate the manner in which the slotted broadband patch antenna of FIG. 6 may be implemented in an antenna array. In general, the slots are preferably positioned perpendicular to the direction of the electrical field E—i.e., perpendicular to the antenna's E-plane and parallel to its H-plane. (The "E-plane" of an antenna is defined as "[f]or a linearly polarized antenna, the plane containing the electric field vector and the direction of maximum radiation," per IEEE Standard Definitions of Terms for Antennas, Std 145-1993. The "H-plane" lies orthogonal to the E-plane and may be defined as "For a linearly polarized antenna, the plane containing the magnetic field vector and the direction of maximum radiation.")

Thus, for example, in FIG. 7, where two broadband patch antennas 710 and 720 are located side-by-side and coupled in the H-plane in an antenna array, the slots of each broadband patch antenna should be aligned end-to-end, as shown, parallel to the direction of H-plane coupling. In contrast, in FIG. 8, where two broadband patch antennas 810 and 820 are located side-by-side and coupled in the E-plane, the slots for each broadband patch antenna should be placed in parallel as shown, perpendicular to the E-plane coupling.

Advantageously, the use of slots in the resonant patch element and their arrangement perpendicular to the E-field results as shown in FIGS. 6 through 8 greatly reduce the size of the patch and hence the mutual coupling between neighboring antenna elements, and thereby improve antenna gain response, radiation patterns, and scanning performance.

The patch antenna in accordance with the present invention provides several advantages over existing patch antennas. In particular, a smaller antenna with better performance can be achieved. Moreover, because the patch antenna of the present invention does not require a high dielectric constant substrate to get a low resonant frequency, it has a very high efficiency and low mass.

It should be understood that the foregoing is illustrative and not limiting and that obvious modifications may be made by those skilled in the art without departing from the spirit of the invention. Accordingly, the specification is intended to cover such alternatives, modifications, and equivalence as may be included within the spirit and scope of the invention as defined in the following claims.

What is claimed is:

1. A patch antenna for transmitting or receiving a wireless signal, comprising:

a base layer having a cavity;

a ground plane located on top of the base layer, and having an opening over at least a portion of the cavity;

a substrate located on top of the ground plane; and a driver patch located on top of the substrate;

wherein the cavity capacitively loads the driver patch.

2. A patch antenna as set forth in claim 1, wherein the ground plane is formed by depositing a conductive material on the bottom of the substrate and the driver patch is formed by depositing a conductive material on the top of the substrate.

3. A patch antenna as set forth in claim 1, wherein at least a portion of the ground plane overlaps the driver patch.

4. A patch antenna as set forth in claim 3, wherein the ground plane opening is centered on, and smaller than, the cavity, such that the ground plane overlaps the driver patch around the entire perimeter of the ground plane.

5. A patch antenna as set forth in claim 1, further comprising:

a parasitic patch above the driver patch.

6. A patch antenna as set forth in claim 5, further comprising means for supporting the parasitic patch comprising at least one of (i) a foam layer located between the driver patch and the parasitic patch, and (ii) a radome.

7. A patch antenna as set forth in claim 5, wherein at least one of the driver patch and the parasitic patch includes one or more slots.

8. A patch antenna as set forth in claim 5, wherein the one or more slots are located perpendicular to the E-field of the wireless signal.

9. A patch antenna as set forth in claim 1 wherein there is no conductor in the opening.

10. A patch antenna as set forth in claim 1 further comprising:

a feed line for the driver patch located on top of the substrate.

11. A patch antenna as set forth in claim 1 wherein said patch is substantially planar and said ground plane is substantially planar and the volume within said antenna between a plane defined by said first ground plane and a plane defined by said patch contains no conductive material.

12. A patch antenna as set forth in claim 1 wherein said patch is substantially planar and said first ground plane is substantially planar and the volume within said antenna between a plane defined by said first ground plane and a plane defined by said patch is fully occupied by dielectric material.

13. A patch antenna as set forth in claim 1 wherein said patch is substantially planar and wherein the space within said antenna between said first ground plane and said patch is fully occupied by dielectric material and there is no conductor coplanar with said patch.

14. A patch antenna as set forth in claim 1 wherein said patch is substantially planar and wherein there is no conductor coplanar with said patch.

15. A method for constructing a patch antenna for transmitting or receiving a wireless signal, comprising the steps of:

providing a base layer having a cavity;

providing a ground plane located on top of the base layer, and having an opening over at least a portion of the cavity;

providing a substrate located on top of the ground plane; and providing a driver patch located on top of the substrate;

wherein the cavity capacitively loads the driver patch.

16. A method as set forth in claim 15, wherein the ground plane is formed by depositing a conductive material on the bottom of the substrate and the driver patch is formed by depositing a conductive material on the top of the substrate.

17. A method as set forth in claim 15, wherein at least a portion of the ground plane overlaps the driver patch.

18. A method as set forth in claim 17, wherein the ground plane opening is centered on, and smaller than, the cavity, such that the ground plane overlaps the driver patch around the entire perimeter of the ground plane.

19. A method as set forth in claim 15, further comprising the steps of:

providing a parasitic patch above the driver patch.

20. A method as set forth in claim 19, further comprising the step of providing at least one of (i) a dielectric layer located between the driver patch and the parasitic patch, and (ii) a radome for supporting the parasitic patch.

21. A method as set forth in claim 19, further comprising the step of providing one or more slots in at least one of the driver patch and the parasitic patch.

22. A method as set forth in claim 21, wherein the one or more slots are located perpendicular to the E-field of the wireless signal.

23. A method as set forth in claim 15 further comprising the step of:

providing no conductor in the opening.

24. A method as set forth in claim 15 further comprising the step of:

providing a feed line for the driver patch on top of the substrate.

* * * * *